US007583231B2

(12) United States Patent
Kwon et al.

(10) Patent No.: US 7,583,231 B2
(45) Date of Patent: Sep. 1, 2009

(54) PRINTED ANTENNA WITH BAND REJECTION FILTER

(75) Inventors: Do-hoon Kwon, Seoul (KR); Young-eil Kim, Suwon-si (KR); Yong-jin Kim, Seoul (KR); Nikolay Petrovich Chubinsky, Moscow (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 556 days.

(21) Appl. No.: 11/339,516

(22) Filed: Jan. 26, 2006

(65) Prior Publication Data

US 2006/0170602 A1 Aug. 3, 2006

(30) Foreign Application Priority Data

Feb. 3, 2005 (KR) ..... 10-2005-0010152

(51) Int. Cl.
*H01Q 9/00* (2006.01)
*H01Q 1/38* (2006.01)

(52) U.S. Cl. ..... 343/749; 343/700 MS; 343/850

(58) Field of Classification Search ..... 343/749, 343/752

See application file for complete search history.

(56) References Cited

U.S. PATENT DOCUMENTS

| | | | | |
|---|---|---|---|---|
| 5,764,189 | A | 6/1998 | Lohninger | |
| 6,958,730 | B2 * | 10/2005 | Nagumo et al. | 343/702 |
| 7,057,568 | B2 * | 6/2006 | Louzir et al. | 343/767 |
| 7,420,511 | B2 * | 9/2008 | Oshiyama et al. | 343/700 MS |
| 2002/0163400 | A1 * | 11/2002 | Toncich | 333/125 |
| 2003/0076260 | A1 * | 4/2003 | Ryken et al. | 343/700 MS |
| 2005/0237131 | A1 * | 10/2005 | Chang et al. | 333/175 |
| 2006/0267844 | A1 * | 11/2006 | Yanagi et al. | 343/700 MS |

* cited by examiner

*Primary Examiner*—Trinh V Dinh
(74) *Attorney, Agent, or Firm*—Sughrue Mion, PLLC

(57) ABSTRACT

An antenna having a band rejection filter. The antenna includes: a radiator formed of a single plate, a grounding part formed of a single plate, a dielectric substrate including a surface on which the radiator is attached and another surface on which the grounding part is attached, and the band rejection filter connected to an end of the radiator. The band rejection filter includes a first capacitor connected to a signal line in parallel, a resonator including an end connected to the first capacitor in parallel and another end grounded, and a second capacitor including an end connected to the first capacitor in series and another end connected to the radiator in series. The resonator includes an inductor and a third capacitor connected to the inductor in series. As a result, the antenna may remove a frequency lower than an ultra wide band pass.

14 Claims, 4 Drawing Sheets

PRINTED ANTENNA WITH BAND REJECTION FILTER

CROSS-REFERENCE TO RELATED APPLICATIONS

This application claims priority from Korean Patent Application No. 2005-0010152, filed on Feb. 3, 2005, in the Korean Intellectual Property Office, the disclosure of which is incorporated herein by reference.

BACKGROUND OF THE INVENTION

1. Field of the Invention

The present invention broadly relates to an antenna. More particularly, the present invention relates to an antenna having a band rejection filter.

2. Description of the Related Art

Existing ultra wide band (UWB) antennas focus on realizing a UWB pass band between 3.1 GHz and 10.6 GHz. However, a technique for developing antennas removing a specific frequency band while keeping a performance of the UWB pass band is required to improve communication performance.

FIG. 1 is illustrates a flat type UWB antenna having a conventional frequency notch function. The contents of the UWB antenna having a conventional frequency notch function is disclosed in Korean Patent No. 2003-0101708, incorporated herein by reference, and will be described as a conventional technique for realizing an antenna having a frequency band rejection function, as shown in FIG. 1. The above-mentioned technique suggests a method of inserting a V-shaped slot 10 into an antenna in a direction interrupting a flow of a current, thereby realizing a specific frequency band rejection function. In other words, the above-mentioned technique adopts a method of adjusting a cut-off frequency depending on a length 20 of the V-shaped slot 10. A global positioning system satellite transmits a GPS band frequency (L2 band: 1227.6 MHz, L1 band: 1575.42 MHz), and a GPS receiver also transmits the GPS band frequency. A cut-off frequency must be adjusted to be less than or equal to a pass band to cut off such a GPS band frequency in a UWB communication system using a pass band between 3.1 GHz and 10.6 GHz.

However, when the cut-off frequency is adjusted to be less or equal to the pass band using the technique disclosed in Korean Patent No. 2003-0101708 and shown in FIG. 1, the length 20 of the V-shaped slot 10 becomes too long. In other words, when the cut-off frequency is less than or equal to the pass band, the length 20 of the V-shaped slot 10 reaches 5.5 cm.

FIG. 2 illustrates a UWB antenna having a conventional frequency selectivity. The UWB antenna shown in FIG. 2 is disclosed in U.S. Patent Publication No.: 2003/0090436A1, incorporated herein by reference. In the UWB antenna, a notch 50 is formed in a substrate type analogue, thereby realizing a frequency cut-off function. However, in a case where a frequency less than or equal to a pass band is cut off using this method, a length 70 of a loop becomes too long. In a case of a UWB antenna requiring a GPS signal notch function, the length 70 of the loop reaches 11 cm.

SUMMARY OF THE INVENTION

Illustrative, non-limiting embodiments of the present invention may overcome the above disadvantages and other disadvantages not described above. The present invention is not necessarily required to overcome any of the disadvantages described above, and the illustrative, non-limiting embodiments of the present invention may not overcome any of the problems described above. The appended claims should be consulted to ascertain the true scope of the invention.

The present invention provides an antenna having a band rejection filter cutting off a frequency less than or equal to a pass band.

According to an aspect of the present inventive concept, an antenna having a band rejection filter is provided. The antenna includes: a dielectric substrate; a radiator attached on a surface of the dielectric substrate; a grounding part attached on an other surface of the dielectric substrate; and the band rejection filter connected to an end of the radiator. The band rejection filter may include: a first capacitor including an end connected to a signal line transmitting a signal input from a signal source; a resonator including an end connected to the other end of the first capacitor and the other end grounded; and a second capacitor including an end connected to the other end of the first capacitor and the other end connected to the radiator.

The first capacitor may be a distributed element, and the second capacitor may be a lumped element. The resonator may include: an inductor and a third capacitor connected to the inductor in series. The third capacitor may be a lumped element. The resonator may have a frequency of about 1.4 GHz.

According to yet another aspect of the present invention, a band rejection filter of a substrate antenna is provided. The band rejection filter includes a first capacitor having a first end connected to a signal line; a resonator having a first end connected to a second end of the first capacitor and a second end grounded; and a second capacitor having a first end connected to the second end of the first capacitor and a second end connected to the radiator.

BRIEF DESCRIPTION OF THE DRAWINGS

The above and/or other aspects of the present inventive concept will be more apparent by describing in detail exemplary embodiments of the present invention with reference to the accompanying drawings. In the drawings, the same reference characters denote analogous elements, in which.

DETAILED DESCRIPTION OF THE EXEMPLARY EMBODIMENTS

Figure 1:
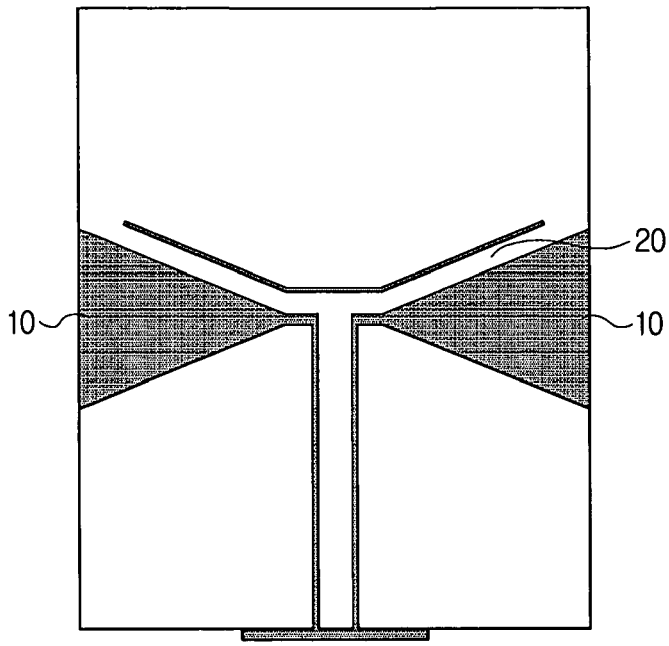
FIG. 1 (PRIOR ART)
FIG. 1 illustrates a flat type UWB antenna having a conventional frequency notch function.
Figure 2:
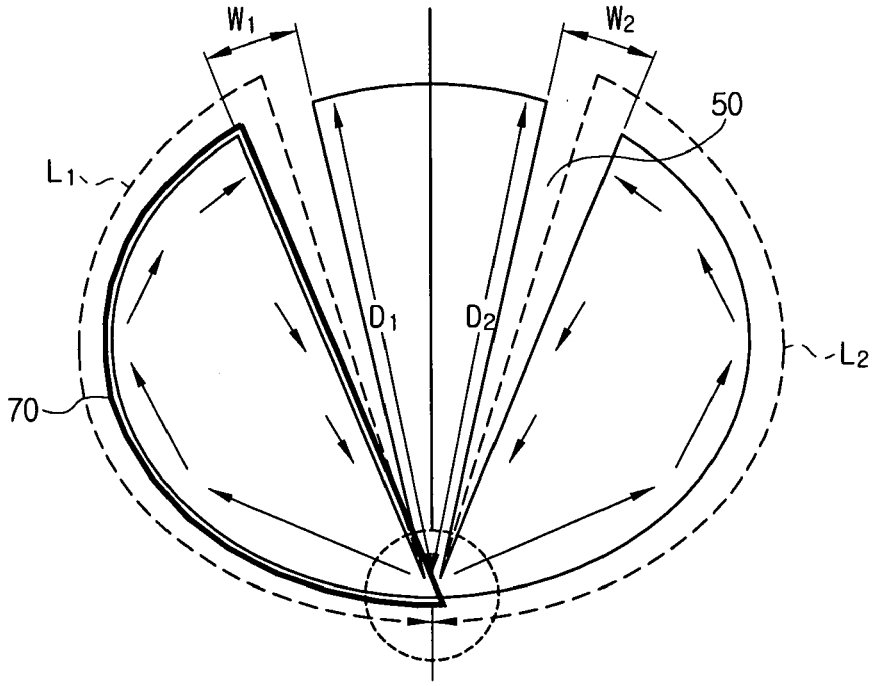
FIG. 2 (PRIOR ART)
FIG. 2 illustrates a UWB antenna having a conventional frequency selectivity.

Exemplary embodiments of the present invention will be described in greater detail with reference to the accompanying drawings.

In the following description, same drawing reference numerals are used to denote analogous elements even in different drawings. The matters defined in the description such as a detailed construction and elements are only provided to assist in a comprehensive understanding of the invention and not by way of a limitation. Thus, it is apparent that the present invention can be carried out without those defined matters. Also, well-known functions or constructions are not described in detail to prevent obscuring the invention in unnecessary details.

Figure 3:
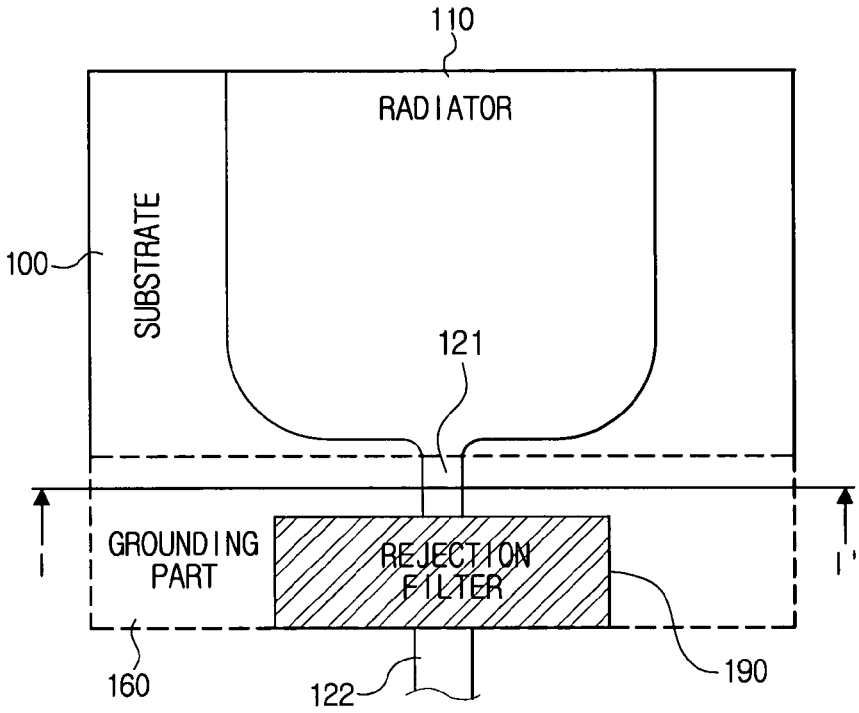
FIG. 3 illustrates an antenna having a band rejection filter according to an exemplary, non-limiting embodiment of the present invention.

FIG. 3 illustrates an antenna having a band rejection filter according to an exemplary embodiment of the present invention. Referring to FIG. 3, the antenna includes a dielectric substrate 100, a signal line 122, a radiator 110, a grounding part 160, and a frequency band rejection filter 190. In FIG. 3, the radiator 110 and the grounding part 160 is each formed of a single plate and are attached on opposite surfaces of the dielectric substrate 100. The frequency band rejection filter 190 is connected to the middle part of the signal line 122. In the example depicted in FIG. 3, the dielectric substrate 100 may be a general-purpose printed circuit board (PCB) such as FR-4 or the like.

Figure 4:
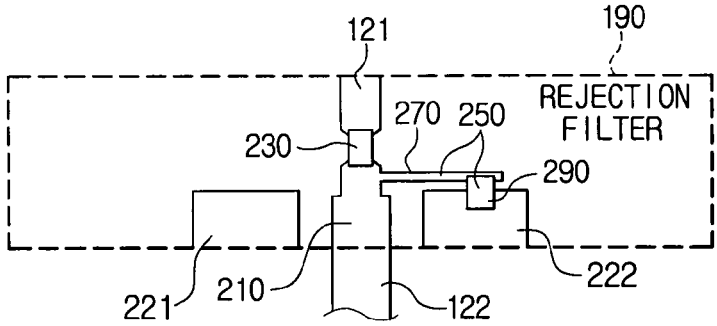
FIG. 4 illustrates a structure of a band rejection filter according to an exemplary embodiment of the present invention.

FIG. 4 illustrates a structure of the frequency band rejection filter 190 according to an exemplary embodiment of the present invention. The frequency band rejection filter 190 includes first, second, and third capacitors 210, 230, and 290 and a resonator 250. In FIG. 4, the resonator 250 is formed through a serial connection between the third capacitor 290 and an inductor 270, and a resonance frequency is about 1.4 GHz. The first capacitor 210 is connected to a signal line 122 in parallel. An end of the resonator 250 is connected to the first capacitor 210 in parallel, and the other end of the resonator 250 is grounded to pad 222. An end of the second capacitor 230 is connected to the first capacitor 210 in series and the other end of the second capacitor 230 is connected to the signal line 121 in series. The first capacitor 210 is a distributed element, the second capacitor 230 is a lumped element, and the third capacitor 290 is a lumped element.

Figure 5:
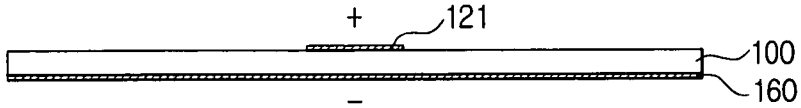
FIG. 5 is a cross-sectional view of a microstrip line of an antenna having a band rejection filter according to an exemplary embodiment of the present invention.

FIG. 5 is a cross-sectional view of a microstrip line of an antenna having a band rejection filter according to an exemplary embodiment of the present invention, taken along line 1-1' shown in FIG. 3. The microstrip line shown in FIG. 5 includes the grounding part 160, the dielectric substrate 100, and a signal line 121.

An antenna having a band rejection filter according to an exemplary embodiment of the present invention will now be described in detail. Table 1 below shows materials for and characteristics of components of the antenna having the band rejection filter according to an exemplary embodiment of the present invention.

TABLE 1

| Component | Characteristic | Material |
|---|---|---|
| Radiator | 20 mm × 20 mm | Copper Coating |
| Grounding Part | 9 mm × 34 mm | Copper Coating |
| Microstrip Line | 2 mm wide | |
| Dielectric Substrate | 1 mm thickness | FR-4 Epoxy (relative permittivity ≅ 4.1 ~ 4.2) |

As shown in Table 1, the radiator is formed of a copper thin film in a size of 20 mm×20 mm, and the grounding part is formed of a copper thin film in a size of 9 mm×34 mm. The microstrip line has a thickness of 2 mm wide. The dielectric substrate is formed of an FR-4 epoxy and has a thickness of 1 mm and has a relative permittivity of approximately 4.1 to 4.2.

Table 2 below shows materials for and characteristics of the components of the band rejection filter according to an exemplary embodiment of the present invention.

| Component | Characteristic | Material |
|---|---|---|
| First Capacitor | 2.1 mm × 2.5 mm | Distributed |
| Second Capacitor | 1.2 pF | Lumped/chip capacitor/0603 type |
| Third Capacitor | 3.0 pF | Lumped/chip capacitor/0603 type |
| Inductor | 6.5 mm | Distributed |

As shown in Table 2, the first capacitor is a distributed element and has a size of 2.1 mm×2.5 mm, and the second and third capacitors are chip capacitors that are lumped elements, are 0603 type, and have capacitances, (measured in a power factor (pF)), of 1.2 pF and 3.0 pF, respectively. The inductor is a distributed element and has a length of 6.5 mm and 0.8 mm wide. The antenna having the band rejection filter according to an exemplary embodiment of the present invention will now be described in more detail with reference to the results of the experiment using the above-described physical properties.

Figure 6:
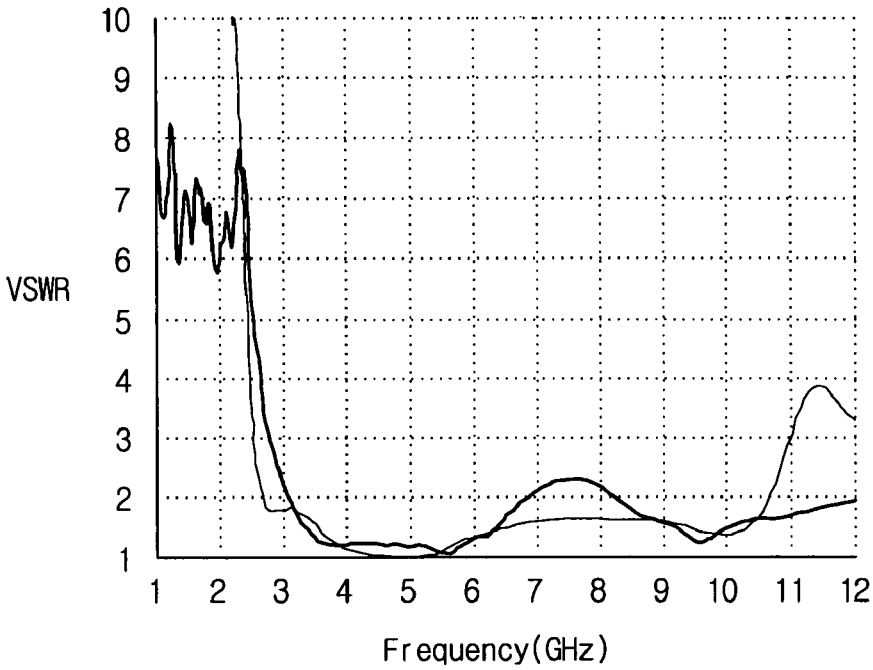
FIG. 6 is a graph illustrating variations in a voltage standing wave ratio (VSWR) with respect to a frequency of an existing UWB antenna and an antenna having a band rejection filter according to an exemplary embodiment of the present invention.

FIG. 6 is a graph illustrating a variation with respect to a frequency of a VSWR of an existing substrate type UWB antenna (depicted with a bold line 610 in FIG. 6) and a variation with respect to a frequency of a VSWR of the antenna having the band rejection filter according to an exemplary embodiment of the present invention (depicted with a regular line 620 in FIG. 6). In FIG. 6, a horizontal axis denotes a frequency (GHz) and a vertical axis denotes a VSWR.

The VSWR is a numerical value indicating matching in a high frequency circuit. In FIG. 6, the substrate type UWB antenna is designed so that the VSWR is less than or equal to "2" in a frequency band between 3.1 GHz and 10.6 GHz. As shown in FIG. 6, observing a variation of the VSWR with respect to the frequency 610 of the substrate type UWB antenna, the VSWR is mostly less than or equal to "2" in the frequency band between 3.1 GHz and 10.6 GHz but exceeds "2" in a frequency band between 7 GHz and 8 GHz.

Also, the VSWR has a relatively low value, (within a range between "6" and "8" as depicted in FIG. 6), in a frequency band less than or equal to 3.1 GHz. However, observing a variation of the VSWR of the antenna having the band rejection filter 620 according to the exemplary embodiment of the present invention, the VSWR is less than or equal to "2" in the frequency band between 3.1 GHz and 10.6 GHz. In particular, the VSWR is sharply increased in the frequency band less than or equal to 3.1 GHz. The antenna according to an exemplary embodiment of the present invention has a much higher radiation control function than the substrate type UWB antenna in a frequency band less than or equal to a UWB pass band including a GPS band (L2 band 1227.6 MHz, L1 band: 1575.42 MHz).

Figure 7:
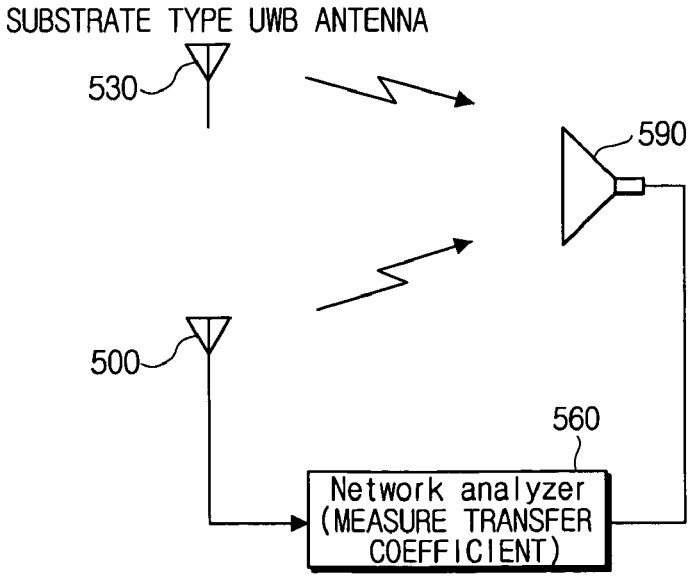
FIG. 7 is a schematic view illustrating an experiment on a measurement of variations of gains with respect to a frequency of an existing UWB antenna and an antenna having a band rejection filter according to an exemplary embodiment of the present invention.

FIG. 7 is a schematic view illustrating results of an experiment on a measurement of variations of gains with respect to a frequency of an antenna having a band rejection filter according to an exemplary embodiment of the present invention and a substrate type UWB antenna. A network analyzer (NA) 560 that is a radio frequency (RF) measurer is used to measure radiation patterns of an antenna 500 having a band rejection filter according to an exemplary embodiment of the present invention and a substrate type UWB antenna 530, so as to compare and measure variations of gains with respect to a frequency. In FIG. 7, a receiver antenna 590 is used to maintain the same measurement conditions with respect to the radiation patterns of the antenna 500 and the substrate type UWB antenna 530. The results of the above-described experiment are shown in FIGS. 8A and 8B.

Figure 8A:
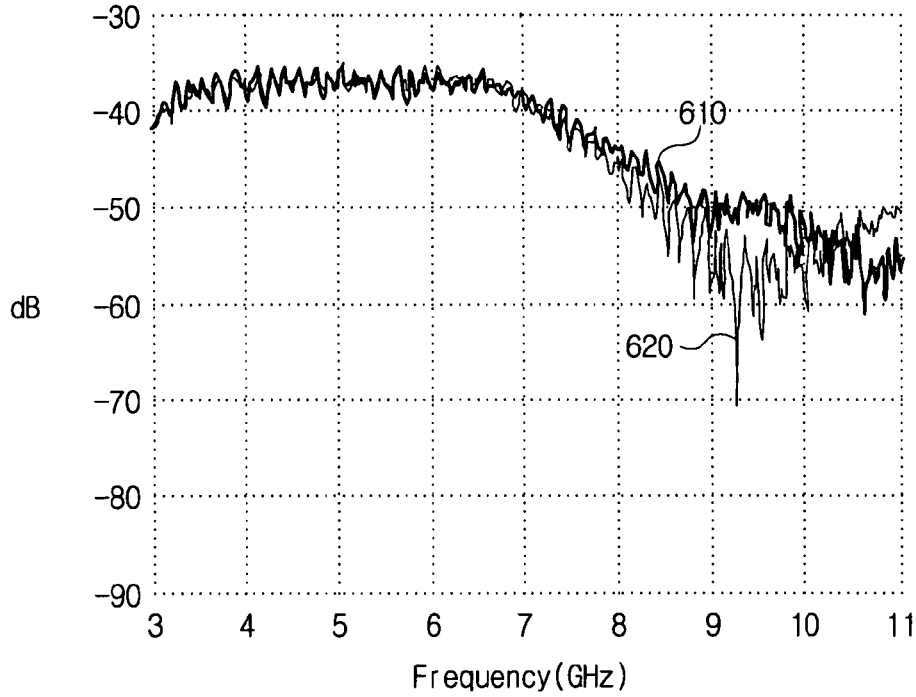
FIGS. 8A and 8B are graphs illustrating characteristics of radiations (gain/transfer function) in a UWB pass frequency and in a frequency less than or equal to a UWB pass band, respectively, of an existing UWB antenna and an antenna having a band rejection filter according to an exemplary embodiment of the present invention.

FIG. 8A is a graph illustrating characteristics of radiations (gain/transfer function) in a UWB pass band frequency of the substrate type UWB antenna (depicted with a bold line 610) and the antenna having the band rejection filter according to an exemplary embodiment of the present invention (depicted in a regular line 620). Referring to FIG. 8A, a gain characteristic of the substrate type UWB antenna and a gain characteristic 620 of the antenna having the band rejection filter are similar in a UWB pass band between 3.1 GHz and 10.6 GHz. Gain characteristics in a frequency band less than or equal to the UWB pass band of the two antennas are compared with reference to FIG. 8B.

Figure 8B:
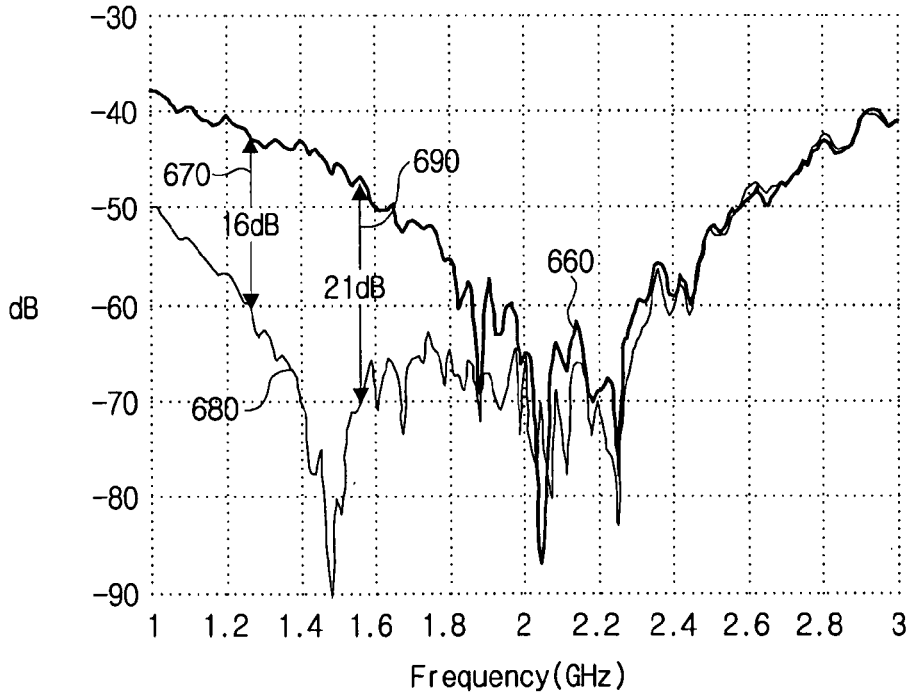

FIG. 8B is a graph illustrating characteristics of radiations (gain/transfer function) in a frequency band less than or equal to the UWB pass band of the substrate type UWB antenna and the antenna having the band rejection filter according to an exemplary embodiment of the present invention. As shown in FIG. 8B, a gain characteristic 660 in a frequency band of 3.1 GHz, which is less than or equal to the UWB pass band of the substrate type UWB antenna and a gain characteristic 680 in a frequency band of 3.1 GHz, which is less than or equal to the UWB pass band of the antenna having the band rejection filter are different. In particular, a gain of the exemplary antenna with a band rejection filter in a GPS band (L2 band: 1227.6 MHz, L1 band: 1575.42 MHz) is reduced by 16 dB 670 and 21 dB 690 compared to a gain of the substrate type UWB antenna. The radiation control function of the antenna having the band rejection filter according to an exemplary embodiment of the present invention is much higher than that of the substrate type UWB antenna in a frequency band less than or equal to the UWB pass band including a GPS band (L2 band: 1227.6 MHz, L1 band: 1575.42 MHz).

As described above, in an antenna having a band rejection filter according to exemplary embodiments of the present invention, a frequency lower than a UWB pass band can be removed. Also, a considerable part of the removal of the frequency lower than the UWB pass band can be achieved in the antenna. Thus, an additional notch filter is not required during designing of the band rejection filter. As a result, requirements for designing the band rejection filter can be simplified. In addition, the performance of a UWB antenna can be prevented from being deteriorated in the UWB pass band between 3.1 GHz and 10.6 GHz during connection of a notch filter to the UWB antenna. The exemplary embodiments of the present invention have been described in detail with reference to a UWB antenna and a GPS signal but the present invention should not construed as being limited to the UWB antenna and the GPS signal.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

In other words, while the exemplary embodiments of the present invention have been particularly shown and described with reference to the accompanying drawings, it will be understood by those of ordinary skill in the art that various changes in form and details may be made therein without departing from the spirit and scope of the present invention as defined by the following claims. It will be understood that the particular structure embodying the invention is shown by way of illustration only and not as a limitation of the invention. The principles and features of this invention may be employed in varied and numerous embodiments without departing from the scope of the invention.

What is claimed is:

1. An antenna comprising:

a substrate;

a radiator formed on a surface of the substrate as a single plate so as to face toward one side of the substrate;

a grounding part formed on another surface of the substrate as a single plate; and a band rejection filter connected to an end of the radiator, wherein the band rejection filter comprises:

a first capacitor comprising a first end connected to a signal line transmitting a signal input from a signal source;

a resonator comprising a first end connected to a second end of the first capacitor and a second end grounded; and a second capacitor comprising a first end connected to the second end of the first capacitor and a second end connected to the radiator.

2. The antenna of claim 1, wherein the band rejection filter is connected to a signal line of the radiator in series.

3. The antenna of claim 1, wherein the first capacitor is a distributed element, and the second capacitor is a lumped element.

4. The antenna of claim 1, wherein the resonator further comprises:

an inductor; and a third capacitor connected to the inductor in series.

5. The antenna of claim 4, wherein the third capacitor is a lumped element.

6. The antenna of claim 1, wherein the resonator has a frequency of approximately 1.4 GHz.

7. The antenna of claim 1, wherein the substrate is dielectric.

8. The antenna of claim 7, wherein the radiator and the grounding part, each comprise a single copper plate and wherein the dielectric substrate has a relative permittivity of approximately 4.1 to 4.2.

9. The antenna of claim 8, wherein the copper plate of the radiator is approximately 20 mm by 20 mm, wherein the copper plate of the grounding part is approximately 9 mm by 34 mm, and wherein the dielectric substrate is formed of an FR-4 epoxy to a thickness of approximately 1 mm.

10. The antenna of claim 1, wherein the band rejection filter is attached to the radiator and the signal line, and wherein the resonator further comprises an inductor and a third capacitor.

11. The antenna of claim 10, wherein the third capacitor is connected to the inductor in series, and wherein the first capacitor is a distributed element and the second capacitor and the third capacitor are lumped elements.

12. The antenna of claim 10, wherein the second capacitor and the third capacitor are 0603 type capacitors.

13. The antenna of claim 10, wherein the inductor is approximately 6.5 mm and the first capacitor has a size of approximately 2.1 mm by 2.5 mm and wherein the second and third capacitors have capacitances of approximately 1.2 pF and 3.0 pF, respectively.

14. The antenna of claim 1, wherein the band rejection filter blocks a frequency lower than an ultra wide band pass and wherein the ultra wide band pass is between 3.1 GHz and 10.6 GHz.

* * * * *